US008146757B2

(12) United States Patent
Abreu

(10) Patent No.: US 8,146,757 B2
(45) Date of Patent: Apr. 3, 2012

(54) BOTTLE FOR DISPENSING FLUIDS

(76) Inventor: Marcio Marc Abreu, North Haven, CT (US)

( * ) Notice: Subject to any disclaimer, the term of this patent is extended or adjusted under 35 U.S.C. 154(b) by 821 days.

(21) Appl. No.: 12/149,509

(22) Filed: May 2, 2008

(65) Prior Publication Data

US 2008/0272082 A1 Nov. 6, 2008

Related U.S. Application Data

(60) Provisional application No. 60/924,169, filed on May 2, 2007.

(51) Int. Cl.
*B65D 1/04* (2006.01)

(52) U.S. Cl. ..... 215/6; 215/370; 222/129; 222/142.4; 220/23.83; 220/503; 220/505; 220/506; 220/524; 220/555

(58) Field of Classification Search ..... 215/6, 370; 222/129, 142.4; 220/23.83, 503, 505, 506, 220/524, 555

See application file for complete search history.

(56) References Cited

U.S. PATENT DOCUMENTS

| | | | | |
|---|---|---|---|---|
| 5,069,675 | A | 12/1991 | Menchel et al. | 604/295 |
| 5,265,770 | A | 11/1993 | Matkovich et al. | 222/189 |
| 5,673,823 | A | 10/1997 | Hanks et al. | 222/185.1 |
| 5,848,999 | A | 12/1998 | Basilice et al. | 604/300 |
| 6,041,978 | A | 3/2000 | Hagele | 222/420 |
| 6,135,985 | A | 10/2000 | Fromer | 604/295 |
| 6,158,623 | A * | 12/2000 | Benavides et al. | 222/129 |
| 6,488,171 | B1 | 12/2002 | Diveley | 220/571 |
| 6,632,202 | B1 | 10/2003 | Hagele | 604/295 |
| 6,752,793 | B1 | 6/2004 | Dascanio et al. | 604/294 |
| 7,063,687 | B2 | 6/2006 | Benktzon et al. | 604/294 |
| 2006/0186144 | A1 | 8/2006 | Tinsley | 222/377 |
| 2007/0113841 | A1 | 5/2007 | Fuchs | 128/200.14 |

* cited by examiner

*Primary Examiner* — Anthony Stashick
*Assistant Examiner* — Elizabeth Volz
(74) *Attorney, Agent, or Firm* — Jacobson Holman PLLC

(57) ABSTRACT

A bottle for dispensing fluids, semi-solid, ointments, gels, paste, creams, powder, and the like. The substances in the container are naturally fed by gravity to a dispensing portion without the need for the dispenser to be placed in a vertical position, upside down position, or inclined position in order to allow the substances to move to the tip of the dispensing portion, all the while maintaining the container in a horizontal orientation.

6 Claims, 6 Drawing Sheets

BOTTLE FOR DISPENSING FLUIDS

This application is a complete application of U.S. Provisional Patent Appln. Ser. No. 60/924,169, filed May 2, 2007, the contents of which are hereby incorporated in its entirety by reference.

FIELD OF THE INVENTION

The present invention relates to a bottle for dispensing medications and other fluids, such as soda, water or sports drinks, and in particular to a specialized container for dispensing fluids, semi-viscous materials, ointments, gels, creams, pastes, and the like.

BACKGROUND OF THE INVENTION

Many patients go blind even after diagnosis and treatment for the disease has been instituted. One classic example is glaucoma. The treatment of glaucoma requires the patient to instill eye drops on a daily basis in order to preserve their sight.

Studies have shown that close to 60% of patients had difficulties with self-administration of eye drops. Current means to administer topical ocular drugs requires the skill of not only administering a correct amount, but also mastering a rather difficult technique. Some of the most limiting steps to administering eye drops are inverting the bottle so as to allow fluid flow to the bottle tip, fright reaction, and bending the neck.

The problems described by patients included: raising their arms above their heads, tilting their heads, holding the inverted bottle and squeezing the bottle with the arms raised, directing the bottle on top of the eye without touching the eye, fear of hitting the eye leading the bottle to the held too high or away from the eye, involuntary blinking or closing eyes after squeezing the bottle, placing the correct number of eye drops, and poor view of the tip of the bottle. The prior art relies on squeeze-bottles, which must be inverted and positioned in an essentially up side down position for use.

In addition, patients with glaucoma frequently need to use more than one medication, which requires having two bottles. Patients tend to misplace bottles, and then sometimes only one eye drop is used, instead of the two medications needed to preserve sight. It would be therefore, an advantage to have paired medications and paired-products which allows the patient to have only one specialized container for the different eye drops.

Furthermore, delivering oral medications to patients, and in particular children requires using a pressure-based system such as a syringe or tipping the medication bottle upside down. The same occur when using ear medication in which the patient must tilt their head and the bottle is held upside down.

SUMMARY OF THE INVENTION

All of these limitations and disadvantages of the prior art are solved by the present invention. With the specialized dispenser of the present invention, the user does not have to invert the bottle and bend their neck in addition to not having to perform all of the other maneuvers described above.

The present invention relates to a bottle for dispensing products, and in particular to a container for dispensing fluids, semi-solid, ointments, gels, paste, creams, powder, and the like. In a preferred embodiment, the substances in the container are naturally fed by gravity to a dispensing portion without the need for the dispenser to be placed in a vertical position, upside down position, or inclined position in order to allow the substances to move to the tip of the dispensing portion, all the while maintaining the container in a horizontal orientation.

The substances are naturally directed to the dispensing portion by a gravity fed structure. The gravity fed structure of this invention includes an essentially slanted member in the interior of the container that is aligned with the nozzle (or opening) of the dispensing portion. Another embodiment of the invention includes a paired-product dispensing system including at least two dispensing portions, each dispensing portion facing the opposite direction of the other dispensing portion and having complimentary closure parts.

In one embodiment, the container includes a bottle having a flexible side wall which is squeezable to dispense the fluid in desired quantities using a gravity fed system. In another embodiment, the container includes at least two chambers joined to each other using a specialized configuration.

In one embodiment a fluid dispensing member, usually in the form of a cap, is mountable to the bottle and has a dispensing tip or dispensing portion (also referred herein as dispensing neck) aligned with a slanted member. The slanted member naturally forces the substance (including fluid) by gravity inside the bottle toward the dispensing portion.

The container may include an inclined member or be configured with an inclined wall or surface. The lower portion of the inclined member or the inclined wall is positioned in communication with the dispensing portion of the container to move the fluid toward the dispensing portion and prevent fluid from moving away from the dispensing portion.

One embodiment of the present invention consists of a fluid-dispensing container for eye care fluid, which dispenses medication from a horizontal position, without the need to turn the bottle upside down while simultaneously allowing the user to see the tip of the dispensing portion. The opening at the dispensing portion may include a neck as used for bottles. The nozzle (or opening) is preferably eccentrically located with respect to one end of the bottle for allowing the largest amount of fluid to be stored inside the fluid containing area. The fluid containing area is formed by the upper walls of the bottle, when the bottle is in a horizontal position, and by the slanted member inside the bottle.

The bottle has essentially two internal areas, an area for storing fluid and a second area separated by the slanted member. The second area underneath the fluid filled chamber may comprise a solid flexible part, such as plastic or be filled with air. In the embodiment of an eye drop dispenser, the dispensing tip preferably has a curved configuration, and is covered by a cap.

Upon squeezing the bottle, the pressure inside the bottle moves the fluid toward the dispensing tip. Due to the slanted member being aligned with and terminating at the nozzle (or opening), the direction of fluid is always toward the nozzle and dispensing tip.

The slanted member preferably has a round or curved configuration to force fluid from the sides to move toward the center of the slanted member. The fluid then flows from the center of the slanted member down to the dispensing tip, similar to a gutter.

Usually people with eye disorders have arthritis, and by having a gravity fed flow, less force is necessary for squeezing the bottle. The slanted member does not allow fluid to move away from the dispensing tip while forcing fluid down during squeezing. A one way valve at the tip can be used, since less force is required to squeeze the bottle because of the gravity fed system of this invention.

As fluid is used, and the amount of fluid is reduced, the slanted member forces the remaining fluid towards the neck of the bottle and with the squeezing of the bottle the fluid is dispensed at the end of the dispensing tip despite the bottle remaining in a horizontal position. The invention therefore allows a simple and low-cost structure to be utilized to store and dispense fluids while keeping the container in a horizontal position despite having very little fluid inside the container.

By keeping the bottle in the horizontal position, the user does not need to look up or bend the neck to instill eye drops. The user can look straight ahead and even use a mirror to position the dispensing tip in alignment with the conjunctival sac under direct visualization for precise placement of the eye drop. Furthermore, there is no fright reaction because the bottle is not held above the head and is not in direct line with the eyes. With the present invention the user can pull down the eyelid, and then the tip of the bottle is held horizontal and below the visual axis which prevents fright reaction.

The same advantage of this invention occurs when using ear medication allowing patients to keep their head straight. This eliminates the need for patients to tilt their heads or hold the medication bottle upside down or in an inclined position.

Any fluid can be optimally delivered with this invention. In many instances, drinking out of a can or bottle is difficult for people having neck injuries, arm injuries, stroke, or arthritis because to finish the drink they have to bend their necks, or/and hold their arms above their heads, and/or have to turn the container (such as a can or bottle) upside down. All of those maneuvers can be painful and difficult. By the present invention, can and bottles can be biologically ergonomically fit, thereby allowing all fluid to be consumed while keeping the container in a horizontal position without having to ever turn the container upside down.

Therefore, another object of the invention is to provide a container, such as a can, bottle, jar, and the like, that can be held in a horizontal position while allowing all fluid to be consumed. It is understood that other containers such as a cup, glass, mug, and the like can have the same slanted member allowing consumption of drinks, yogurts, and any other semi-solid products and the like without having to bend the neck and while maintaining the container in a horizontal position in relation to the ground. The lower end of the slanted member ends at the edge of the cup, glass, mug, and the like, and the upper end of the slanted member ends at the uppermost part of the container.

Accordingly, in one embodiment the beverage (or any fluid or substance) is dispensed from the bottle including glass bottles, without the need for squeezing the bottle, and the fluid or substance is directed to the dispensing portion by virtue of a slanted member. The slanted member does not let fluid move away from the dispensing outlet while the fluid is being dispensed. It is understood that the slanted member can be replaced by a straight member, which is angled with respect to the bottom wall of the bottle. The straight member is positioned aligned with the dispensing portion. This allows fluid to move toward the dispensing tip, while avoiding fluid to be retained inside the bottle.

A further object of the invention is to provide a dispensing apparatus that allows two or more different eye drop solutions to be held in the same containing structure while keeping the fluids separate. One of the challenges overcome by this invention is to prevent a dispensing tip of a double tip dispenser from touching the eye. Another problem with having two different fluids in the same container is that different amounts may be needed for each fluid. For example, a glaucoma patient may need on a daily basis one eye drop of a prostaglandin analog but need three drops of a carbonic anhydrase inhibitor. This would lead to one container emptying faster than the other container.

The dispenser comprised of at least two chambers is particularly useful with regard to fluids which are to be dispensed in different dosages over extended periods of time, and or products which are to be dispensed in different amounts over a certain period of time. By proportioning the two chambers so that medications are dispersed at a proportionate rate, both chambers will be emptied at the same time.

For example, the chamber requiring two drops per dose would be twice as large as a chamber requiring one drop per dose. The two chambers would thereby be emptied at the same time.

Patients commonly have to use more than one eye drop. Besides patients, doctors also have to treat patients using more than one eye drop. For example, before surgery a doctor has to apply an antibiotic and anti-inflammatory drug. With the prior art the doctor needs to carry two containers. With the present invention the doctor carries only one container which has the two drugs, and only with a flip of the dispenser the second eye drop can be administered without the risk of touching the eye. If more than one medication has to be dispensed, as occurs prior to surgery, the doctor can conveniently carry only one eye drop dispenser while dispensing at least two medications.

A two-liter bottle of a carbonated beverage demands consumption of all of the contents within a short time otherwise the carbonation is released and the beverage does not taste good. In a lot of instances, part of the contents are not used because the carbonation is lost. Therefore, it would be useful for a container, as in accordance with the invention, that allows consumption of smaller quantities while making available large amounts of beverage. This is a accomplished by the two-chamber system of the invention. One chamber which has essentially a triangular configuration holds one liter, and is anchored to the other container. The second container having an essentially triangular configuration, matches the triangular configuration of the first container. The two matching triangular configuration creates an essentially rectangular configuration or alternatively a square configuration, which is stable and well balanced.

In addition, the triangular configuration allows the use of the gravity fed system of the invention. Each container has a cap, with one cap facing one direction and the opposite cap facing an opposite direction. Preferably, one cap faces upward and the opposite cap faces downwards. Each cap has a level configuration preferably flat to allow keeping the two chamber container in a standing upright position. Preferably, the bottle has a round configuration, but it is understood that any geometric configuration can be used, or a combination of geometric configurations.

It is an object of the present invention to provide a dispenser for dispensing fluids, semisolid, solids, gels, pastes, ointments, powder, creams, and the like which solves or is an improvement over the problems and deficiencies of the art.

A further object of the present invention is to provide a fluid dispenser which remains in a horizontal position during use.

A further object of the present invention is to provide a container which is gravity fed by virtue of a slanted surface member and the container remains in a horizontal position during use.

Another object of the present invention is to provide a dispenser, which allows multiple fluids, of variable dosages, to be dispensed.

A further object of the present invention is to provide a dispenser which prevents the tip of the dispenser from touching the eye or creating fright reaction.

Another object of the present invention is to provide a dispenser with two tips which prevents any of the tips from touching the eye or creating fright reaction.

A still further object of the present invention is to provide a paired product dispenser, which allows dispensing different amounts of the product from the container.

Another object of the present invention is to provide a container that is gravity fed.

BRIEF DESCRIPTION OF THE DRAWINGS

The following drawings illustrate examples of various components of the bottle disclosed herein, and are for illustrative purposes only. Other embodiments that are substantially similar can use other components that have a different appearance.

DETAILED DESCRIPTION OF THE PREFERRED EMBODIMENTS

Figure 1:
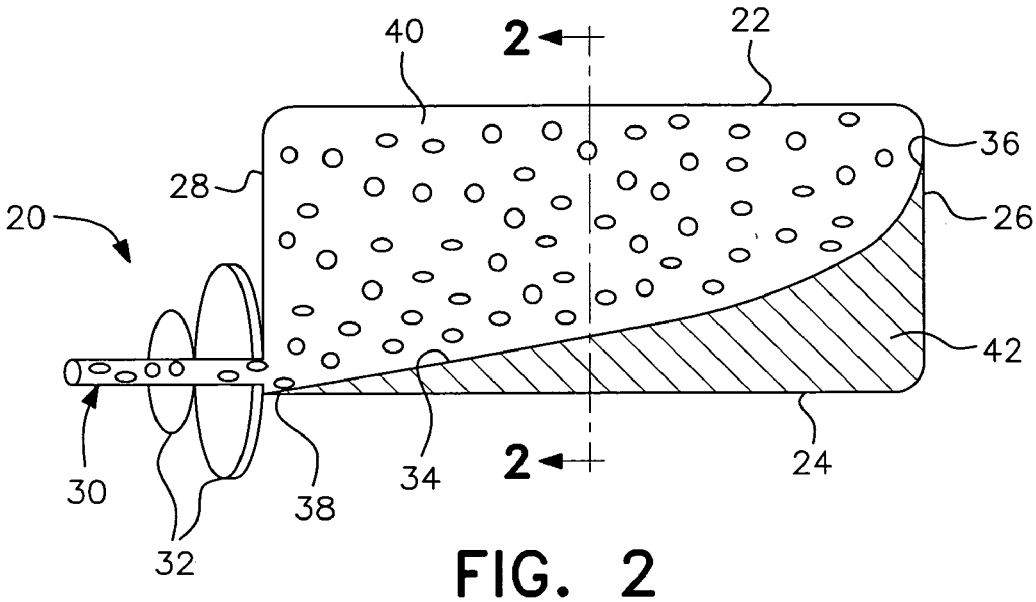
FIG. 1 is a sectional view of a bottle according to the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
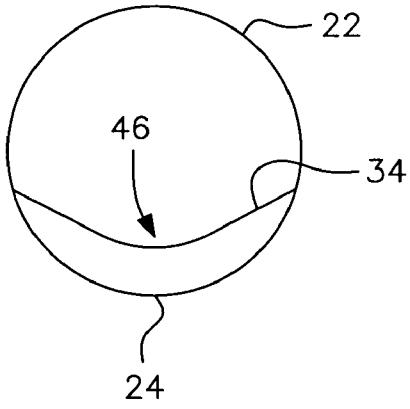
FIG. 2 is a cross-sectional view taken along line 2-2 of FIG. 1.

With reference to the drawings, in general, and to FIGS. 1 and 2, in particular, a bottle embodying the teachings of the subject invention is generally designated as 20. With reference to its orientation in FIG. 1, the bottle includes an upper wall 22, a lower wall 24, an end 26 and an end 28.

The bottle may be cylindrical, horizontal or any other geometric shape. An outlet or dispensing nozzle 30, having threads 32 for securing a cap thereto, is eccentrically mounted in end 28.

Figure 3:
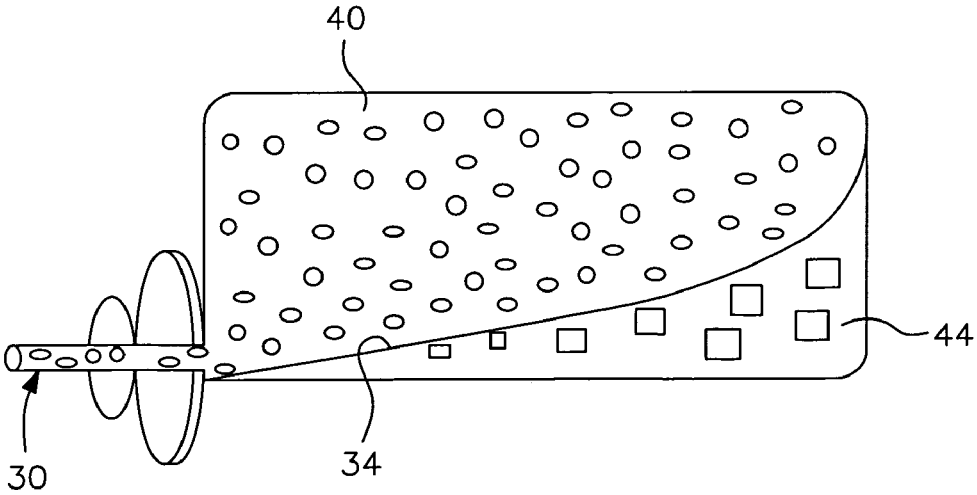
FIG. 3 is a sectional view of an alternate embodiment of the bottle shown in FIG. 1.

Located in the interior of the bottle is an inclined wall 34 extending from end 26 at point 36 and terminating at point 38 at the lower wall 24. Point 38 is located adjacent to the outlet 30. Inclined wall 34 separates the contents of the bottle located in chamber 40 from a fill material 42 located below inclined wall 34. The fill material 42, as shown in FIG. 1, is a solid plastic. Alternatively, as shown in FIG. 3, the fill material 44 may be air or other fluid occupying the space below the inclined surface 34. The purpose of the fill materials 42, 44 is to support the inclined surface 34 so that the contents in chamber 40 are always fed by gravity to the outlet 30.

As shown in cross section in FIG. 2, the inclined wall 34 is also curved along its length from point 36 to point 38. This provides a bottom channel or gutter 46 to help guide the contents of the chamber 40 to the outlet 30. By removal of a cap or other closure mechanism from the outlet 30, the contents of chamber 40 are fed through the outlet 30 even while the bottle 20 is maintained in the horizontal orientation shown in FIGS. 1 and 3.

Figure 4:
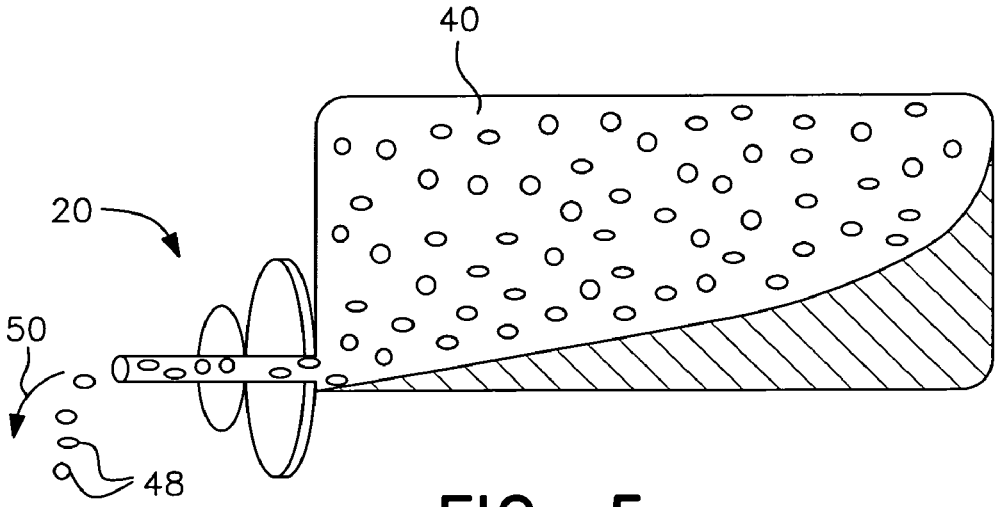
FIGS. 4-6 illustrate the progressive emptying of a bottle according to FIG. 1 while the bottle is held in a horizontal orientation.
Figure 5:
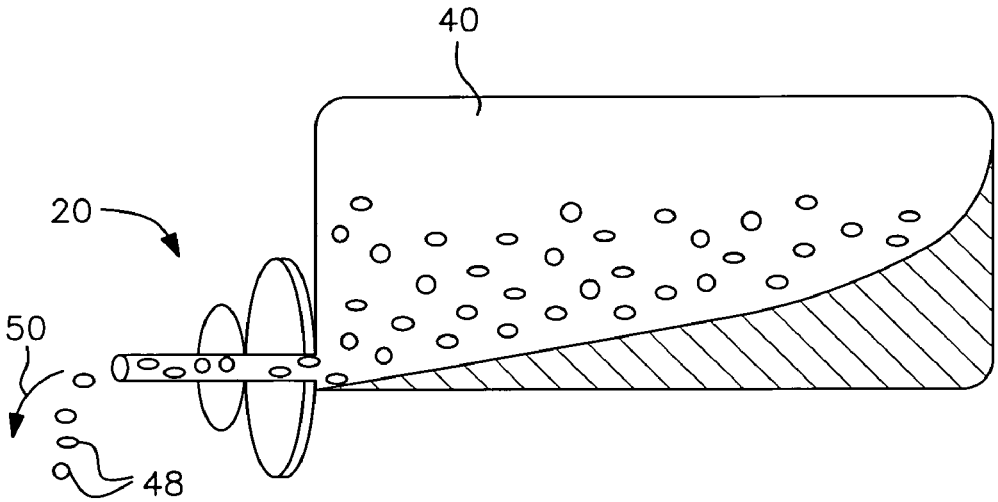
Figure 6:
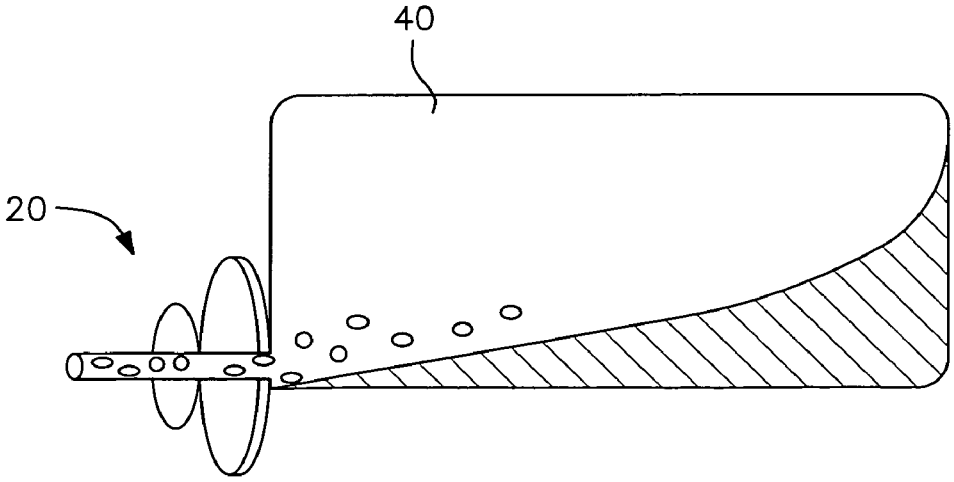

The progression of the contents in chamber 40 is shown in FIGS. 4 through 6. The release of the contents of chamber 40 is illustrated by droplets 48 moving in the direction of arrow 50 from the full bottle 20 shown in FIG. 4, and a partially filled bottle 20 shown in FIG. 5, until an almost entirely empty bottle shown in FIG. 6.

Figure 7:
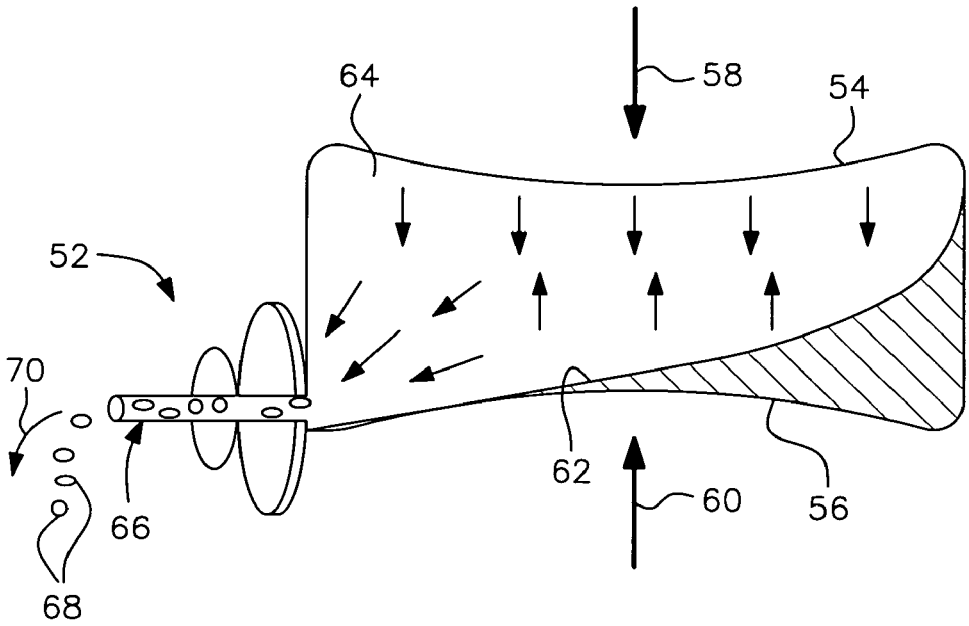
FIG. 7 illustrates a squeezable bottle having an eccentrically mounted outlet at one end of the bottle.

Alternatively, a bottle 52, as shown in FIG. 7, may have an upper wall 54 and a lower wall 56 which are squeezable towards each other in the direction of arrows 58, 60, respectively. An inclined wall 62 aids in transmission of the contents of chamber 64 towards the outlet 66 so that droplets 68 move in the direction of arrow 70. Again, the orientation of the bottle 52 is horizontal so that the contents of the bottle in chamber 64 may be removed from the bottle without a tilting of the bottle.

Figure 8:
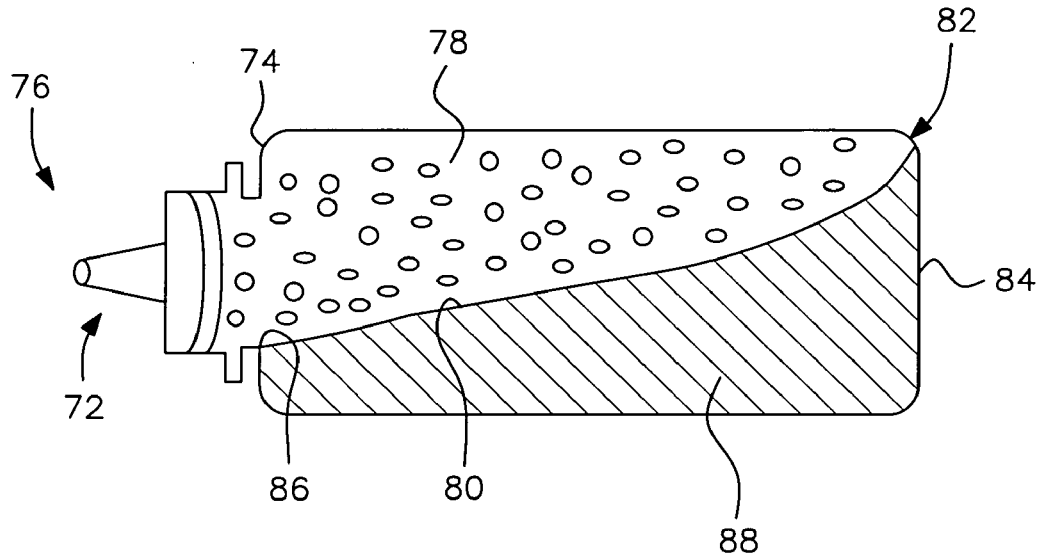
FIG. 8 is a sectional view of a bottle having a centrally mounted outlet at one end of the bottle.

In FIGS. 1 through 7, the outlet or dispensing nozzle is located eccentrically in one of the two end walls. Alternatively, as shown in FIG. 8, the dispenser nozzle 72 may be located centrally in end wall 74. In this embodiment, to force the contents of the bottle 76 from chamber 78, an inclined surface 80 extends from an upper portion 82 of end wall 84 and terminates at point 86 located just below an entrance to nozzle 72.

In this embodiment, chamber 78 occupies approximately 50% of the volume of the bottle 76. The remainder of the bottle includes fill material 88 of either solid material or air as described for FIGS. 1 and 3. Bottle 76 appears similar to a known dispensing bottle; however, the bottle 76 takes advantage of the present invention in dispensing all of the contents of chamber 78 while maintaining a horizontal orientation of the bottle 76.

Figure 9:
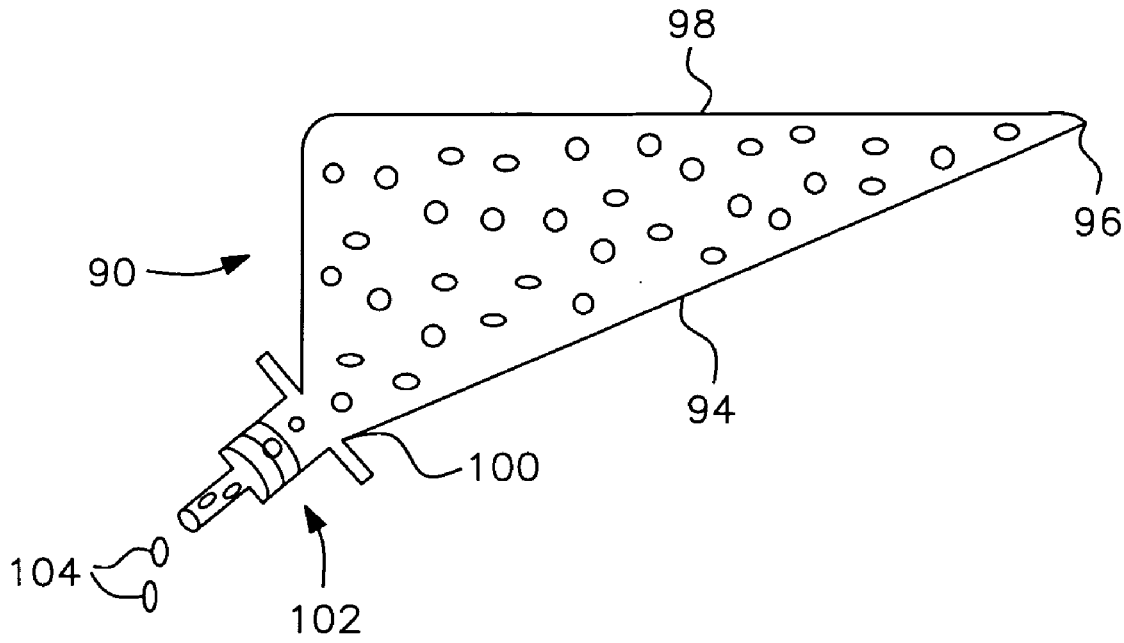
FIG. 9 is a sectional view of an alternate embodiment having an inclined bottom wall forming the lowermost surface of the bottle.
Figure 10:
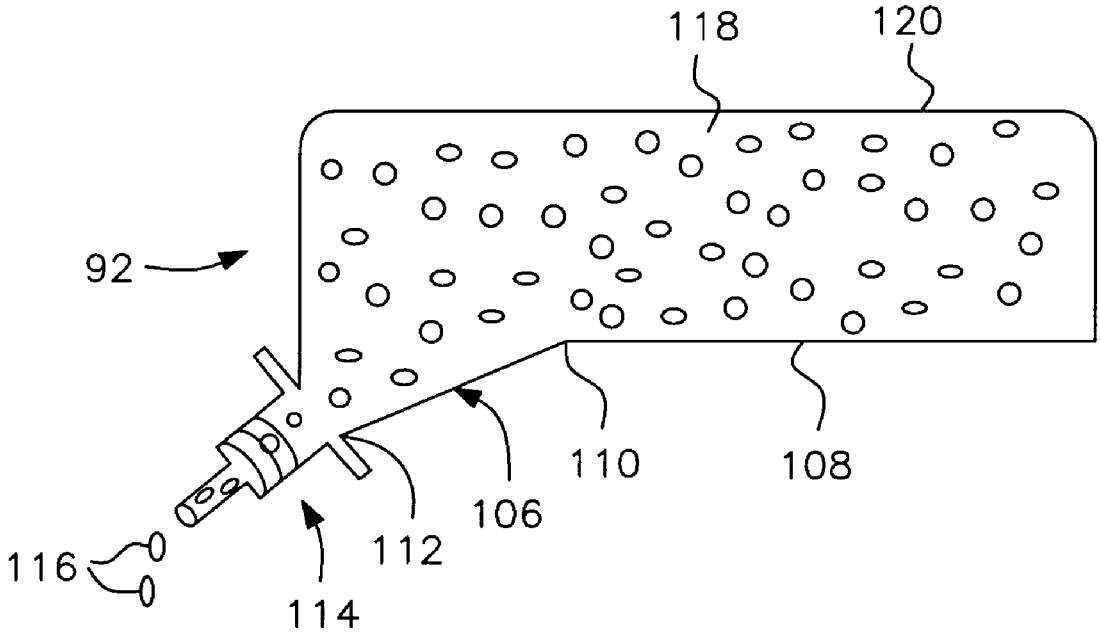
FIG. 10 is a modified alternate embodiment illustrating a portion of the bottom wall being angled and terminating at the outlet.

In FIGS. 9 and 10, bottles 90, 92, respectively, are shown. The bottle of FIG. 9 includes inclined wall 94 forming the lowermost wall of the bottle. Inclined wall or surface 94 takes advantage of the principles of the present invention while avoiding the need to fill a portion of the bottle with a fill material. The inclined wall 94 extends from an uppermost portion 96 located at upper wall 98 and terminates at point 100 adjacent to outlet or dispensing nozzle 102 for gravity fed release of droplets 104.

Similarly, in FIG. 10, the inclined surface 106 forms a portion of lower wall 108 extending from point 110 at the lower wall and terminating at point 112 adjacent to outlet or dispensing nozzle 114 for release of droplets 116.

In this embodiment, only a portion of the lower wall includes the inclined wall portion 106 for gravity feed of the contents of chamber 118 towards the outlet 114 while maintaining a horizontal orientation of the bottle 92. It is conceivable, in this embodiment, that the upper wall 120 and lower wall 108 may be deformable to aid in moving the contents of chamber 118 towards the inclined wall portion 106 leading to the outlet 114.

Figure 11:
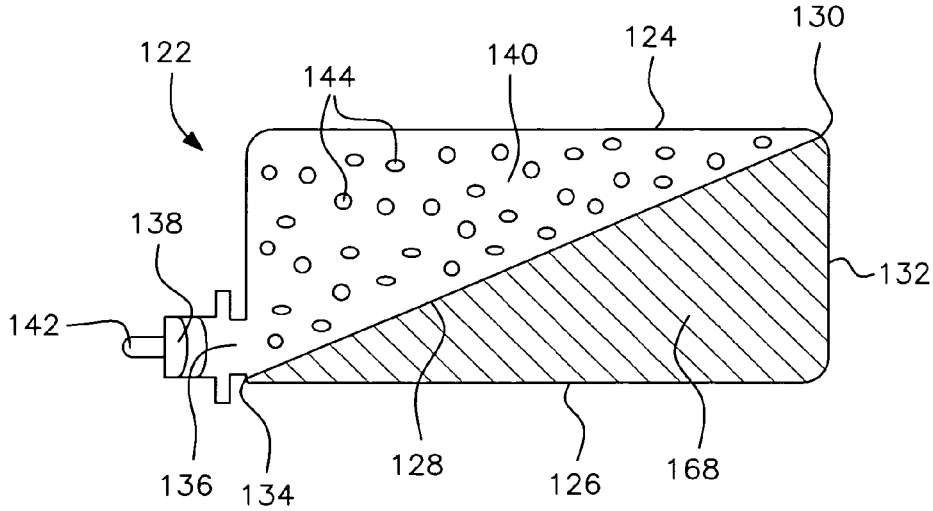
FIGS. 11 and 12 illustrate eccentrically mounted outlets at one end wall of a bottle and an interior inclined wall extending from the uppermost wall and terminating at the outlet.

In FIG. 11, bottle 122 includes upper wall 124 and lower wall 126. Inclined surface 128, in this bottle, extends linearly from the intersection 130 of end wall 132 and upper wall 124 and terminates at point 134 adjacent to a neck 136 of a pull top dispensing mechanism 138 to allow transmission of the contents of chamber 140 to the outlet 142. In this embodiment, the inclined surface 128 is flat and, due to the low viscosity of the liquid contents 144 of the bottle 122, the contents 144 are rapidly evacuated from the bottle 122 upon opening of the dispensing mechanism 138.

Figure 12:
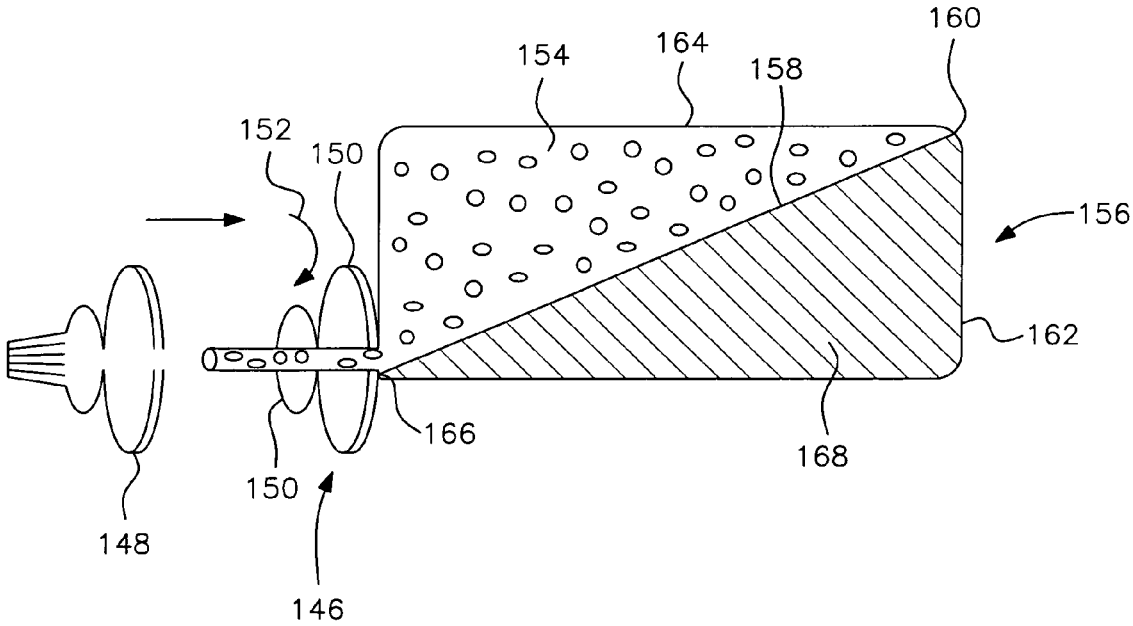

Similarly, in FIG. 12, an eccentrically mounted outlet or nozzle 146 having a screw on top 148 is screwed onto threads 150 in the direction of arrow 152 to secure the contents in chamber 154 of the bottle 156. Similarly to FIG. 11, the inclined surface 158 is flat and extends from the intersection 160 of the end wall 162 and upper wall 164 and terminates at point 166 adjacent to the nozzle 146. The bottom half of the bottle is filled with a solid fill material 168 in FIGS. 11 and 12.

Figure 13:
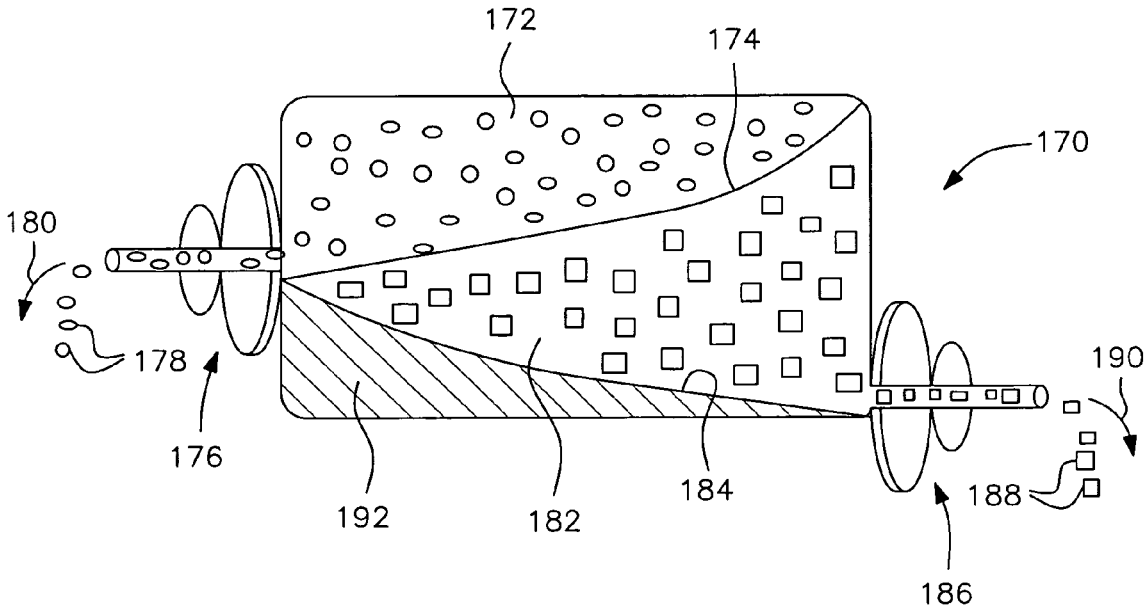
FIG. 13 illustrates an alternate embodiment including two bottle chambers each with an eccentrically mounted outlet located at an end wall and including a curved lowermost wall terminating at the outlet.
Figure 14:
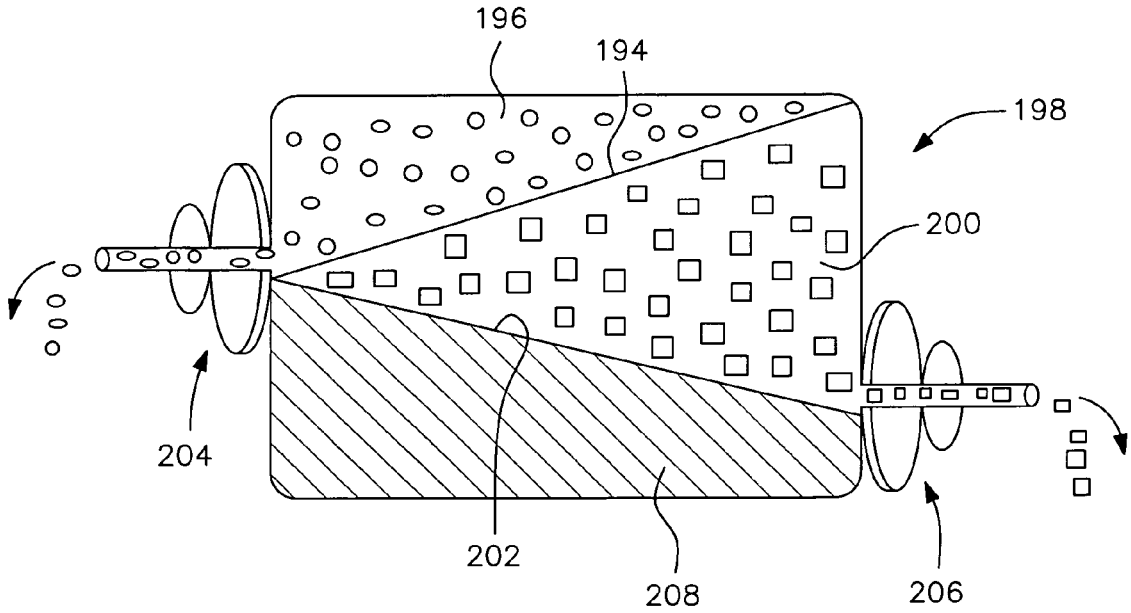
FIG. 14 is a sectional view, similar to FIG. 13, having inclined, but not curved, lowermost walls terminating at a respective outlet eccentrically mounted in one end wall.

FIGS. 13 and 14 illustrate alternate embodiments of the present invention in which two dispensing nozzles are used to release the contents of two separated chambers contained in the single bottle.

In FIG. 13, bottle 170 includes a chamber 172 having a curved inclined surface 174 leading to dispensing outlet or nozzle 176 for release of droplets 178 in the direction of arrow 180. Vertically below chamber 172 is chamber 182 having curved inclined wall 184 for guiding the contents of chamber 182 to dispensing nozzle or outlet 186 for release of droplets 188 in the direction of arrow 190. Vertically below the chamber 182 is fill material 192 to complete the volume of the bottle 170. In this embodiment, two disparate materials may be separately stored in a single bottle and be released from the bottle while maintaining the bottle in a horizontal orientation.

FIG. 14 is similar to FIG. 13 except that, in FIG. 14, the inclined surface 194 of chamber 196 of bottle 198 is flat. Vertically lower chamber 200 includes inclined surface 202 as its lower wall.

Inclined surface 194 leads the contents of chamber 196 to outlet nozzle or dispenser 204, whereas the inclined wall 202 leads the contents of chamber 200 to outlet nozzle or dispenser 206. The portion of the bottle 198 located below chamber 200 includes fill material 208.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A bottle comprising a container having at least two chambers, the container including an upper wall, a lower wall and two spaced end walls, and each of the chambers having an inclined bottom wall and an outlet, said inclined bottom wall terminating at the outlet, the outlet being located in one of the two end walls and spaced from the lower wall, the inclined bottom wall of one of the at least two chambers being formed between the at least two chambers and the inclined bottom wall of the other of the at least two chambers being formed by a portion of the container including fill material.

2. A bottle comprising a container having two chambers, the container including an upper wall, a lower wall spaced from the upper wall, two spaced end walls, and an outlet at each of the two spaced end walls, an inclined bottom surface of each of the two chambers formed by a wall extending spaced from the lower wall, and the inclined bottom surface of each of the two chambers terminating at said respective outlet of each of said two chambers, the respective outlet of each of said two chambers being located centrally in a height direction in said two end walls, the inclined bottom surface of one of the two chambers being formed between the two chambers and the inclined bottom surface of the other of the two chambers being formed spaced from said lower wall.

3. The bottle of claim 2, wherein said inclined bottom surface extends transverse to the lower wall.

4. The bottle of claim 2, wherein said inclined bottom surface is curved.

5. The bottle of claim 2, wherein said inclined bottom surface is flat.

6. The bottle of claim 2, wherein said inclined bottom surface of said one of said two chambers extends from the upper wall to the outlet.

* * * * *